US010788025B2

(12) United States Patent
Ishikura et al.

(10) Patent No.: US 10,788,025 B2
(45) Date of Patent: Sep. 29, 2020

(54) FUEL PUMP

(71) Applicant: DENSO CORPORATION, Kariya, Aichi-pref. (JP)

(72) Inventors: Michihisa Ishikura, Kariya (JP); Seiji Kunihiro, Kariya (JP)

(73) Assignee: DENSO CORPORATION, Kariya (JP)

( * ) Notice: Subject to any disclaimer, the term of this patent is extended or adjusted under 35 U.S.C. 154(b) by 283 days.

(21) Appl. No.: 15/464,766

(22) Filed: Mar. 21, 2017

(65) Prior Publication Data

US 2017/0276125 A1 Sep. 28, 2017

(30) Foreign Application Priority Data

Mar. 23, 2016 (JP) ..... 2016-58917

(51) Int. Cl.

| | |
|---|---|
| ***F04B 9/04*** | (2006.01) |
| ***F04B 1/066*** | (2020.01) |
| ***F04B 1/0413*** | (2020.01) |
| ***F04B 1/06*** | (2020.01) |
| ***F02M 59/10*** | (2006.01) |
| ***F02M 59/02*** | (2006.01) |
| ***F04B 53/14*** | (2006.01) |
| *F02D 41/38* | (2006.01) |

(52) U.S. Cl.

CPC ..... *F04B 9/042* (2013.01); *F02M 59/027* (2013.01); *F02M 59/102* (2013.01); *F04B 1/0413* (2013.01); *F04B 1/06* (2013.01); *F04B 1/066* (2013.01); *F04B 53/14* (2013.01); *F02D 41/3845* (2013.01)

(58) Field of Classification Search

CPC .. F04B 9/042; F04B 1/066; F04B 1/06; F04B 53/14; F04B 1/0413; F02M 59/102; F02M 59/027

See application file for complete search history.

(56) References Cited

U.S. PATENT DOCUMENTS 6,314,945 B1 * 11/2001 Sugiyama ..... F02D 41/08 123/299
6,694,952 B1 * 2/2004 Yamazaki ..... F02M 59/102 123/496
2008/0098991 A1 * 5/2008 Eddy ..... F02D 41/3845 123/504

FOREIGN PATENT DOCUMENTS

JP 2001-41128 A 2/2001
JP 2002-31018 A 1/2002
JP 2002-322967 11/2002

* cited by examiner

*Primary Examiner* — Abiy Teka
(74) *Attorney, Agent, or Firm* — Nixon & Vanderhye, P.C.

(57) ABSTRACT

A fuel pump includes a cylinder that forms a compression chamber which pressurizes a fuel, a plunger that compresses the fuel in the compression chamber, a cam that pushes the plunger, and a driven gear that engages a driving gear to transmit a rotational driving force. A profile of the cam is configured such that a peak arrival range is half or less of a compression range. Cam speed is obtained by differentiating a lift amount of the plunger by a rotation angle of the cam, the compression range is an angle range during which the plunger is pushed in the direction of compressing the fuel, and the peak arrival range is an angle range from a start of the compression range until a most retarded position of a peak of the cam speed.

7 Claims, 10 Drawing Sheets

FUEL PUMP

CROSS REFERENCE TO RELATED APPLICATION

The present application is based on Japanese Patent Application No. 2016-58917 filed on Mar. 23, 2016, disclosure of which is incorporated herein by reference.

TECHNICAL FIELD

The present disclosure relates to a fuel pump that compresses and discharges fuel by a plunger pushed by a cam.

BACKGROUND

A fuel pump described in JP 2002-322967A includes a cylinder that forms a compression chamber which compresses a fuel, a plunger that compresses the fuel in the compression chamber, and a cam that pushes the plunger to compress the fuel. The fuel pressurized in the compression chamber is discharged. Further, this fuel pump includes a rotation shaft to which the cam and a driven gear are fixed. By rotating the driven gear with a driving gear, the rotation shaft is rotated along with the cam.

Cam speed is defined as a value obtained by differentiating the movement amount that the cam pushes the plunger (i.e., a lift amount) by the rotation angle of the cam. Further, cam speed waveform is defined as a waveform that represents the value of the cam speed with respect to rotation angle. The cam speed waveform is specified by the external shape (i.e., profile) of the cam.

For example, the cam profile may include a portion with a shape that suddenly increases in distance from the rotation center of the cam toward radially outward, i.e., a portion where the pressure angle is high. In this case, the plunger will suddenly lift up when the cam only rotates by a small amount, and the cam speed is high. Conversely, the cam profile may include a portion with a shape that gently increases radially outward, i.e., a portion where the pressure angle is low. In other words, the cam speed waveform includes sections where the cam speed is high due to a high pressure angle, and sections where the cam speed is low due to a low pressure angle.

SUMMARY

The cam profile described in JP 2002-322967A as mentioned above may reduce driven contact noise by slowing the driven contact, but may insufficiently reduce driving contact noise, and there may be room for improvement.

The present disclosure may provide a fuel pump that maintains the discharge function of a pump while sufficiently reducing gear meshing noise.

In one aspect of the present disclosure, a fuel pump that compresses and discharges fuel includes a cylinder that forms a compression chamber which pressurizes a fuel, a plunger that compresses the fuel in the compression chamber, a cam that pushes the plunger in a direction of compressing the fuel, and a driven gear that engages a driving gear to rotate, the driven gear transmitting a rotational driving force of the driving gear to the cam to rotate the cam. The cam pushes the plunger by a lift amount, a cam speed is defined as a value obtained by differentiating the lift amount by a rotation angle of the cam, a compression range is defined as an angle range of the rotation angle during which the plunger is pushed in the direction of compressing the fuel, a peak arrival range is defined as an angle range from a start of the compression range until a most retarded position of a peak of the cam speed, and a profile of the cam is configured such that the peak arrival range is half or less of the compression range.

According to this aspect, the cam profile is configured such that the peak arrival range is half or less of the compression range. Accordingly, the cam speed increases and reaches the peak at an early timing after the plunger begins lifting up, and the compression period after the peak is longer. Thus, during a compression period while plunger load is low, cam speed may be sufficiently increased to increase cam torque, and cam workload may be maintained while reducing driving contact noise. Further, after the peak as well, cam workload may be maintained while beginning the decrease of torque at an earlier timing, and so contact driving noise may be reduced further. Accordingly, the discharge function of the fuel pump may be maintained while sufficiently reducing gear meshing noise.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
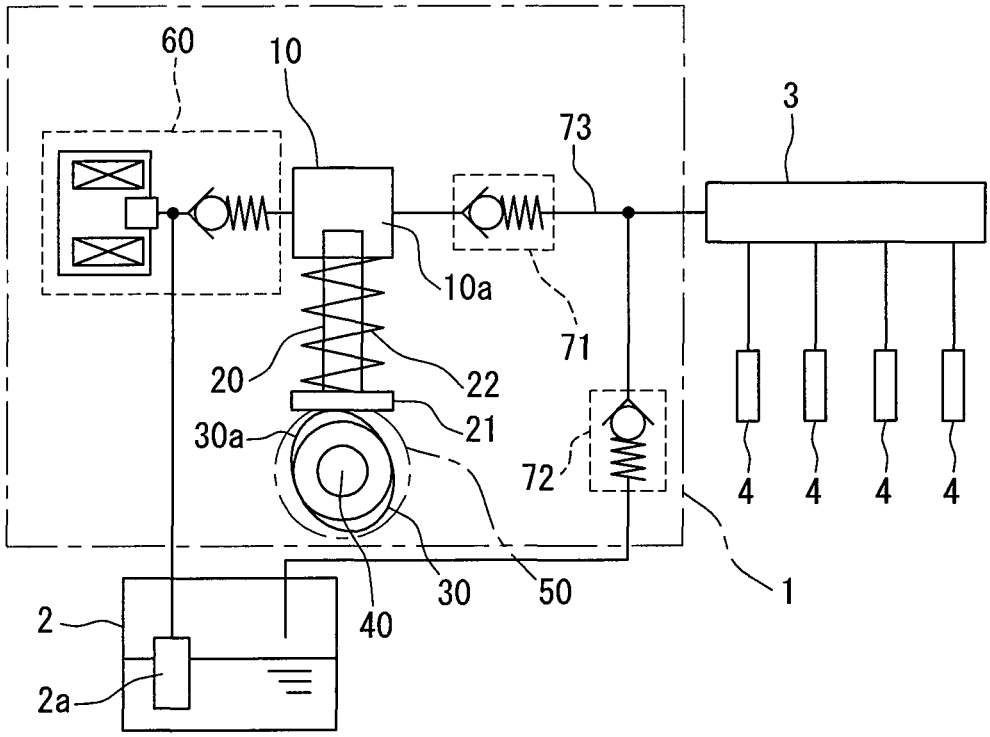
FIG. 1 is a schematic view of the configuration of a fuel pump.

Hereinafter, a plurality of embodiments of the present disclosure will be discussed with reference to the figures. In each embodiment, portions which correspond to matters already discussed in previous embodiments may be denoted with the same reference numerals, and overlapping explanations thereof may be omitted. In each embodiment, if only a partial configuration is described, the remaining portions of the configuration may be adapted from those of the other embodiments.

First Embodiment

A fuel pump 1 shown in FIG. 1 is mounted in a vehicle, and is a high pressure pump that pressurizes fuel from a fuel tank 2 and discharges the fuel. The fuel discharged from the fuel pump 1 is stored in a common rail 3, and is then distributed to fuel injection valves 4 disposed in each cylinder of an internal combustion engine. Then, the fuel is injected at high pressures from the fuel injection valves 4. The injected fuel is used for combustion in the internal combustion engine. A portion of the output torque of the internal combustion engine obtained by the combustion is used to drive the fuel pump 1. A low pressure pump 2*a* disposed inside the fuel tank 2 is driven by an electric motor, and supplies low pressure fuel to the fuel pump 1.

The fuel pump 1 includes a cylinder 10, a plunger 20, a cam 30, a rotation shaft 40, a driven gear 50, and a regulator valve 60 as will be described below. The cylinder 10 forms a compression chamber 10*a* that pressurizes fuel. The plunger 20 reciprocates within the cylinder 10 to intake fuel into the compression chamber 10*a*, and to compress and pressurized the intake fuel.

In particular, a tappet 21 is disposed between the plunger 20 and the cam 30. The cam 30 pushes the plunger 20 through the tappet 21 and, as a result, the plunger 20 moves in a direction to compress the fuel (i.e., to lift up). Further, an elastic member 22 is provided with an elastic force which causes the plunger 20 to move in a direction to intake the fuel (i.e., to lift down). The lift up period of the plunger 20 is referred to as a compression period, and the lift down period of the plunger 20 is referred to an as intake period. As shown in FIG. 1, the cam 30 of the present embodiment has a shape that includes two peaks, and so during one rotation of the cam 30, the plunger 20 reciprocates twice.

Figure 2:
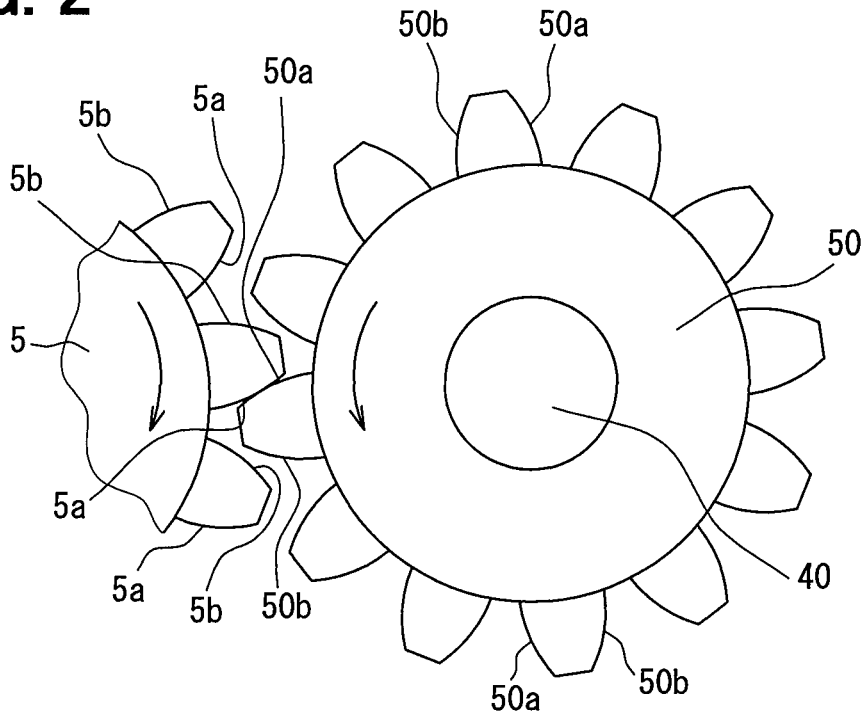
FIG. 2 shows a driving gear and a driven gear in a meshed state.

The cam 30 and the driven gear 50 are fixed to the rotation shaft 40, and integrally rotate with the rotation shaft 40. As shown in FIG. 2, the driven gear 50 engages with a driving gear 5 to rotate, thereby causing the rotation shaft 40 to rotate. In other words, a rotating driving force of the driving gear 5 is transmitted through the driven gear 50 and the rotation shaft 40 to the cam 30, and drives the plunger 20 to lift up. The driving gear 5 is driven by the output torque of the internal combustion engine to rotate. Accordingly, when the internal combustion engine is in operation, the driving gear 5 is always rotating. Further, the rotation speed of the driving gear 5 changes in accordance with changes in the rotation speed of the output shaft of the internal combustion engine. As a result, the rotation speed of the cam 30 also changes.

Further, during lift up, a front tooth surface 5*a* of the driving gear 5 transmits rotation torque to a front tooth surface 50*a* of the driven gear, and the driving gear 5 causes the driven gear 50 to rotate. Conversely, during lift down, a rear tooth surface 50*b* of the driven gear 50 transmits rotation torque to a rear tooth surface 5*b* of the driving gear 5, and the driven gear 50 causes the driving gear 5 to rotation.

Here, the present inventors closely examined gear mesh noise caused by the meshing of gears. As a result, it was determined that a driving contact noise and a driven contact noise exist in the gear mesh noise, as will be described below. The driving contact noise is generated when the cam 30 pushes the plunger 20 to pressurize the fuel and, as shown in FIG. 2, the front tooth surface 5*a* of the driving gear 5 collides with the front tooth surface 50*a* of the driven gear 50. The driven contact noise is caused by, when the plunger 20 pushes the cam 30 in the direction of intaking fuel, the rear tooth surface 5*b* of the driving gear 5 collides with the rear tooth surface 50*b* of the driven gear 50. Then, through experimentations by the present inventors, it was determined that the driving contact noise is greater than the driven contact noise. In particular, in the case of a high pressure fuel pump, the torque during compression is significantly higher than torque during intake. In other words, the present inventors determined that, in order to reduce gear mesh noise, it may be particularly effective to reduce the driving contact noise.

As described above, in the gear mesh noise caused by the meshing of the driving gear 5 and the driven gear 5, both the driving contact noise and the driven contact noise exist. The driving contact noise is caused by the front tooth surfaces 5*a*, 50*a* colliding, and the driven contact noise is caused by the rear tooth surfaces 5*b*, 50*b* colliding.

The regulator valve 60 is electromagnetically actuated, and is driven to open and close by an electronic control unit (not illustrated). During the intake period, the regulator valve 60 is driven to open, thereby allowing low pressure fuel to be sucked into the compression chamber 10*a*. During the compression period, by closing the regulator valve 60 at a requested timing, the timing for when fuel actually begins to be compressed may be controlled.

Specifically, during the compression period, the regulator valve 60 is nevertheless controlled to be open for a period. During this time, even though the plunger 20 is lifting up, the fuel in the compression chamber 10*a* is not compressed, and instead returns to the fuel tank 2 through the regulator valve 60. Thereafter, once the regulator valve 60 is closed, the fuel in the compression chamber 10*a* is compressed by the lifting plunger 20.

In other words, the actual fuel compression period during the compression period is when the regulator valve 60 is closed. Then, by controlling the timing of when the regulator valve 60 begins to close, the amount of fuel compressed in the compression chamber 10*a*, and thus the discharge amount of high pressure fuel from the fuel pump 1, may be controlled. For example, the regulator valve 60 may be controlled to control the discharge amount of the fuel pump 1 based on a deviation between the actual pressure inside the common rail 3 and a target pressure. Here, instead of the regulator valve 60 shown in FIG. 1, a regulator valve which controls the size of the opening of the intake passage may be used, and the intake amount may be controlled by controlling the size of this opening. Further, if the pressure of the fuel compressed in the compression chamber 10*a* exceeds an upper limit, a check valve 71 opens to supply the compressed high pressure fuel to the common rail 3. In addition, when the pressure in a high pressure passage 73 exceeds an abnormal value due to, for example, the injection holes of the fuel injection valves 4 becoming damaged and blocked, a relief check valve 72 opens to return the fuel in the high pressure passage 73 back to the fuel tank 2.

Figure 3:
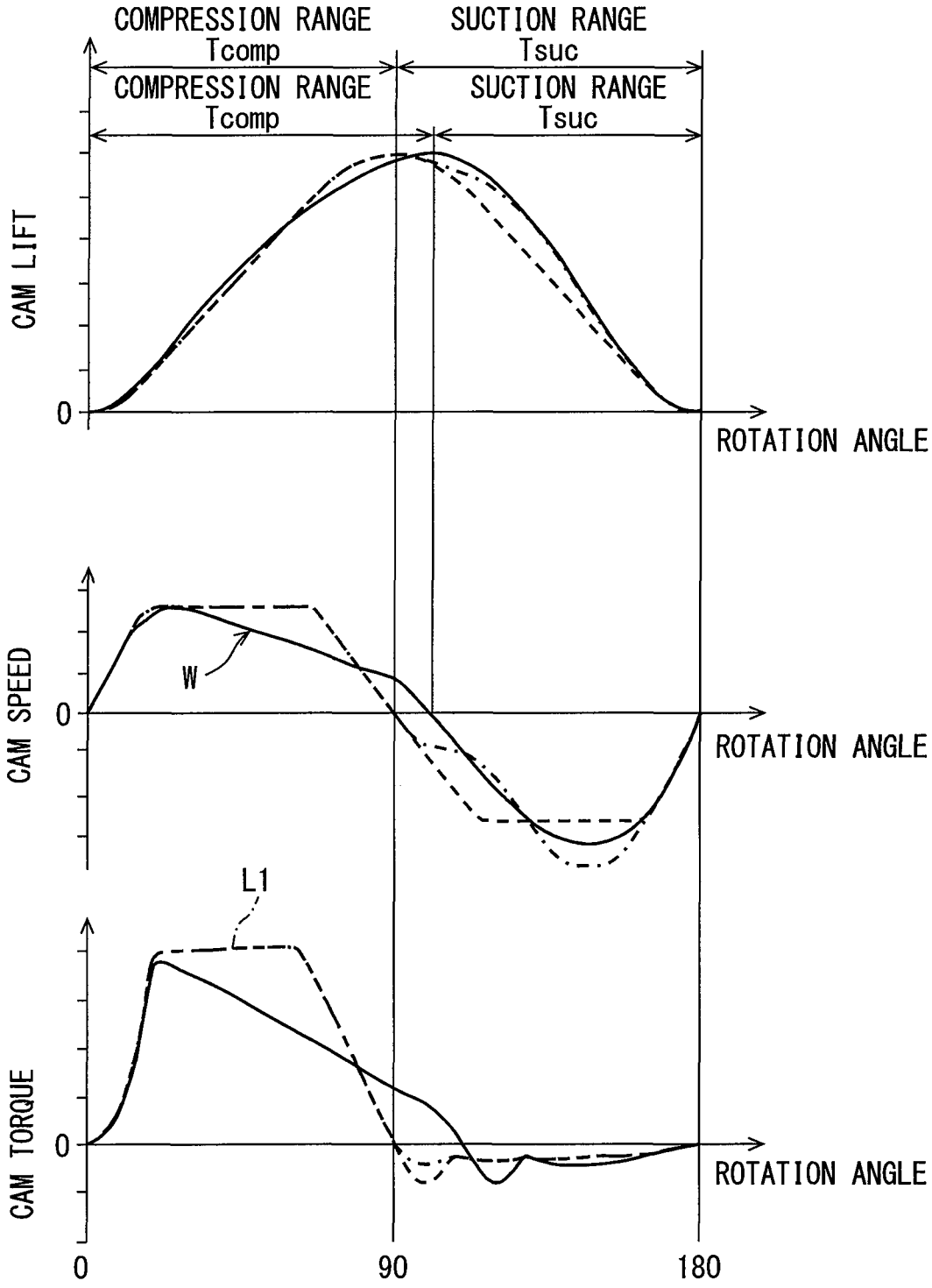
FIG. 3 shows changes in cam lift, cam speed, and cam torque with respect to rotation angle.

FIG. 3 shows the rotation angle of the cam 30 on the horizontal axis and various physical quantities on the vertical axis. In particular, FIG. 3 shows changes in cam lift at the top of the figure, cam speed at the center of the figure, and cam torque at the bottom of the figure. The solid lines in FIG. 3 correspond to the profile of the cam 30 in the present embodiment. The dashed lines in FIG. 3 correspond to the cam profile of a first comparative example, and the one-dot-one-dash lines in FIG. 3 correspond to a second comparative example.

Cam lift is defined as the movement amount (i.e., lift amount) of the plunger 20 as the plunger 20 reciprocates along a cam surface 30*a*. The cam surface 30*a* is the circumferential surface of the cam 30. Cam speed is defined as a value obtained by differentiating lift amount by the rotation angle of the cam 30. Cam torque is defined as a value obtained by multiplying plunger load with pressure angle.

Further, a lift waveform is defined as a waveform that shows changes in cam lift respect to changes in rotation angle, i.e., the waveform shown at the top of FIG. 3. A cam speed waveform W is defined as a waveform that shows changes in cam speed with respect to changes in rotation angle, i.e., the waveform shown at the center of FIG. 3. Further, a cam torque waveform is defined as a waveform that shows changes in cam torque with respect to changes in rotation angle, i.e., the waveform shown at the bottom of FIG. 3.

The lift waveform is specified by the shape of the cam surface 30*a*. Specifically, the lift waveform is specified by the outer shape of the cam surface 30*a* when viewed from the rotation center line direction (see FIG. 1), i.e., the profile of the cam 30. Accordingly, the cam speed waveform W and the cam torque waveform may also be said as being specified by the profile of the cam 30. In other words, if the cam profile is specified, then the lift waveform is unambiguously specified. If the life waveform is specified, then the cam speed waveform is unambiguously specified. Then, if the cam speed waveform is specified, then the cam torque waveform is unambiguously specified. Further, the various waveforms shown by solid lines in FIG. 3 correspond to the profile of the cam 30 of the present embodiment. Meanwhile, the waveforms shown by the dashed lines in FIG. 3 correspond to the profile of a first comparative example, and the one-dot-one-dash lines in FIG. 3 correspond to a second comparative example.

A range of the rotation angle during which the plunger 20 transitions from bottom dead center to top dead center corresponds to a compression range Tcomp. Further, a range of the rotation angle during which the plunger transitions from top dead center to bottom dead center corresponds to a suction range Tsuc. As illustrated, the compression ranges Tcomp of the first comparative example and the second comparative example are set to be equal to the suction ranges Tsuc, at 90 degrees. Conversely, the cam profile of the present embodiment is defined such that the compression range Tcomp is longer than the suction range Tsuc.

Figure 4:
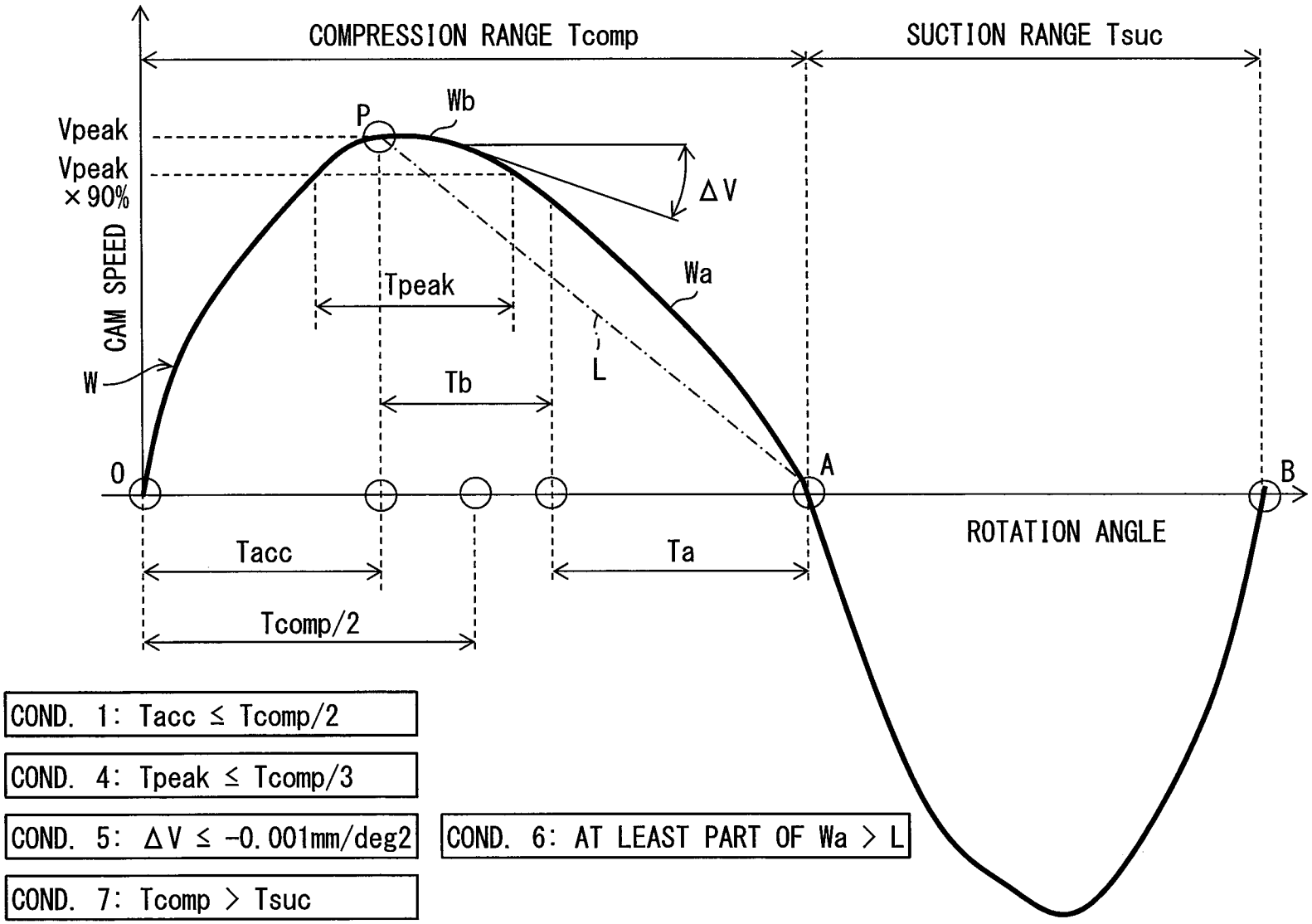
FIG. 4 is a cam speed waveform that shows in detail the cam speed waveform of the solid line in the center of FIG. 3.

FIG. 4 is a detailed view of the cam speed waveform W shown by the solid line in the center of FIG. 3. The profile of the cam 30 is configured to result in this illustrated cam speed waveform W. In FIG. 4, point 0 indicates the beginning of the compression range Tcomp, and point A indicates the end of the compression range Tcomp, i.e., the beginning of the suction range Tsuc. Further, point B in FIG. 4 indicates the end of the suction range Tsuc, i.e., the beginning of the next compression range Tcomp. Point P in FIG. 4 shows the rising peak point of the cam speed V.

The angle range from the beginning of the compression range Tcomp until a most retarded position of the rising peak point P is referring to as a peak arrival range Tacc. In the waveform of FIG. 4, descend begins at the same time as reaching the rising peak point P, and so a most advanced position of the rising peak point P (i.e., a peak arrival position) coincides with the most retarded position of the rising peak point P. The cam speed at the rising peak point P is referring to as a peak speed Vpeak, and a subrange of the compression range Tcomp which is equal to or above the peak speed Vpeak is referring to as a peak range Tpeak.

Further, an angle range from a rotation angle which is retarded from the rising peak point P by a particular angle until the end point A of the compression range Tcomp is referring to as a compression end range Ta. Here, the portion of the cam speed waveform W within the compression end range Ta is referring to as a compression end waveform Wa. An angle range from the rising peak point P until a rotation angle retarded from the rising peak point P by a particular angle is referred to as a peak following peak Tb. The portion of the cam speed waveform W within the peak following peak Tb is referring to as a peak following waveform Wb.

As described above, in order to reduce gear mesh noise, it is more effective to prioritize reducing the driving contact noise. Here, to reduce the driving contact noise, the present inventors contemplated that it may be preferable to reduce cam torque during the compression range Tcomp, and then after reaching the peak arrival range Tacc, quickly begin decreasing the cam torque. Here, to quickly begin decreasing the cam torque means to begin the decrease of the cam torque at an earlier timing. The cam torque is a value obtained by multiplying the load received by the cam 30 from the plunger 20 (i.e., plunger load) by pressure angle as described above. Accordingly as plunger load and pressure angle are reduced, cam torque is also reduced and driving contact noise is reduced.

Further, as described previously, as cam speed is reduced, pressure angle and cam torque are also reduced. Conversely, plunger load steadily increases once the plunger 20 begins compression and lifts up, and the earlier in the compression range Tcomp, the small the plunger load. Accordingly, by sufficiently increasing cam speed during the portion of the compression range Tcomp when plunger load is low, cam speed can be increased to a sufficiently high value without significantly increasing the driving contact noise. Further, as compression continues and plunger load increases, cam speed may be reduced to a small value to further reduce driving contact noise.

In the present embodiment, the cam speed waveform W has a shape which satisfies the following seven conditions.

Condition 1: the peak arrival range Tacc is half or less of the compression range Tcomp.

Condition 2: the cam speed, upon arriving at the rising peak point P, does not remain at the value at the rising peak point P, and immediately decreases.

Condition 3: the rising peak point P occurs once during the compression range Tcomp.

Condition 4: the peak range Tpeak is one third or less of the compression range Tcomp.

Condition 5: a cam acceleration ΔV (see FIG. 4) obtained by differentiating the cam speed V by rotation angle includes a portion which is equal to or below $-0.001$ mm/deg$^2$, and this portion exists within the peak following waveform Wb.

Condition 6: for at least a portion of the compression end waveform Wa, the cam speed value is greater than a straight line L connecting the rising peak point P and the end point A of the compression range Tcomp.

Condition 7: the compression range Tcomp is greater than the suction range Tsuc.

Regarding condition 6 described above, in the present embodiment in particular, the entirety of the compression end waveform Wa may be at a greater cam speed value than the straight line L (condition 6A). More specifically, the entirety of the cam speed waveform W from the rising peak point P until the end point A of the compression range Tcomp, i.e., the entirety of the compression end range Ta and the peak following range Tb, may be at a greater cam speed value than the straight line L (condition 6B).

The peak arrival range Tacc of the cam speed waveform W has a curved shape that protrudes upward, and has a shape where the cam speed steadily increases toward the rising peak point P. The compression end range Ta and the peak following range Tb of the cam speed waveform W have curved shapes which protrude upward, and have shapes where the cam speed steadily approaches zero.

Next, the technical significance of condition 1 will be explained based on FIGS. 5 to 8.

Figure 5:
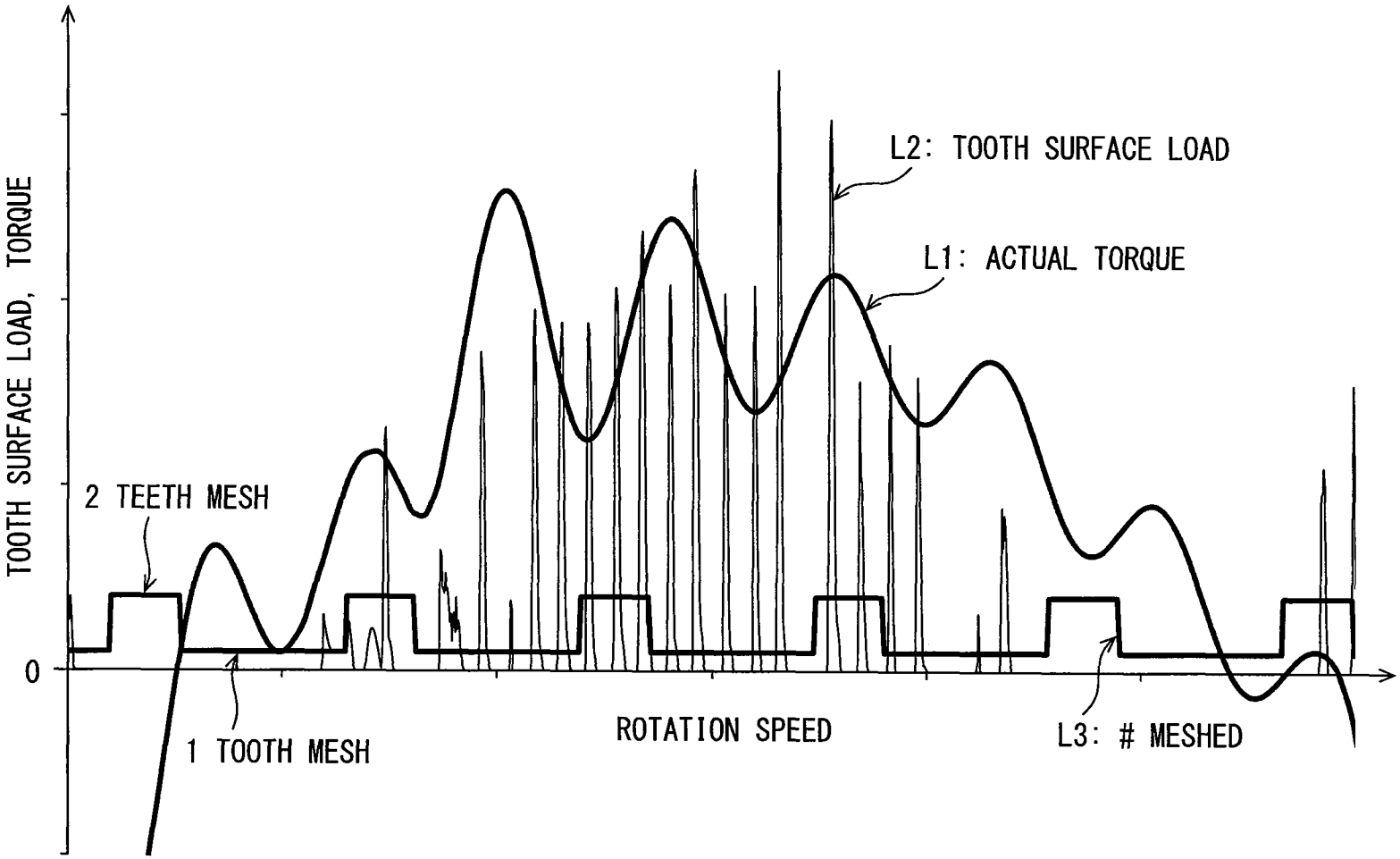
FIG. 5 shows changes in tooth surface load and torque with respect to rotation angle.

In FIG. 5, the horizontal axis shows rotation angle, and the solid line L1 shows the actual torque received by the cam 30 from the plunger 20 which is lifting up. In other words, this is the magnitude of the cam torque needed to cause the plunger 20 to lift up in the compression range Tcomp. This solid line L1 is defined by the cam speed waveform W, and is a detailed view of the cam torque of the first comparative example denoted by L1 in the bottom of FIG. 3. The line L1 is pulsating in FIG. 5 because the rotation shaft 40 is rotationally fluctuating due to torsional resonance.

The solid line L2 in FIG. 5 shows the load applied to the front tooth surface 50*a* of the driven gear 50 from the front tooth surface 5*a* of the driving gear 5. In other words, L2 shows the magnitude of tooth surface load, which is the cause of driving contact noise, in the compression range Tcomp. From the solid lines L1 and L2, it is understood that as cam torque increases, tooth surface load also increases. Further, it is understood that tooth surface load violently fluctuates with no relationship to the pulsations in the cam torque.

The solid line L3 in FIG. 5 shows changes in the number of teeth which are meshed between the driving gear 5 and the driven gear 50. In other words, L3 shows changes between a state where two pairs of teeth are meshed such that two front tooth surfaces 5*a* of the driving gear 5 are simultaneously in contact with two front tooth surfaces 50*a* of the driven gear 50, and a state where only one pair of teeth are meshed such that one front tooth surface 5*a* of the driving gear 5 is in contact with one front tooth surface 50*a* of the driven gear 50. From the solid lines L2 and L3, it is understood that the violent fluctuations in tooth surface load is unrelated to the mesh state of the teeth.

From these solid lines L1, L2, and L3, the present inventors contemplated that the violent fluctuations in tooth surface load may be caused by the following bounce phenomenon. Specifically, this bounce phenomenon occurs when, during one compression period, the front tooth surface 50*a* of the driven gear 50 bounces on the front tooth surface 5*a* of the driving gear 5, and the front tooth surfaces 50*a*, 5*a* collide with each other many times. Further, the collision load caused by these bounces periodically peaks, and is contemplated to be the cause of the violent fluctuations in tooth surface load. In this regard, by reducing the peaks of this collision load, the driving contact noise may be reduced.

In order to reduce the peak values of this collision load, the load that the cam 30 receives from the plunger 20 (i.e., plunger load) may be reduced by reducing the maximum lift amount. Accordingly, the tooth surface load is reduced, thereby reducing the peak value of the collision load and reducing driving contact noise. For example, as shown by the dashed line in FIG. 6, by reducing the maximum lift amount from point A1 to point A2, the noise level caused by tooth collision may be reduced to be lower than a target value THa. However, if the maximum lift amount is reduced below a target value THb, the cam workload may be insufficient.

Figure 7:
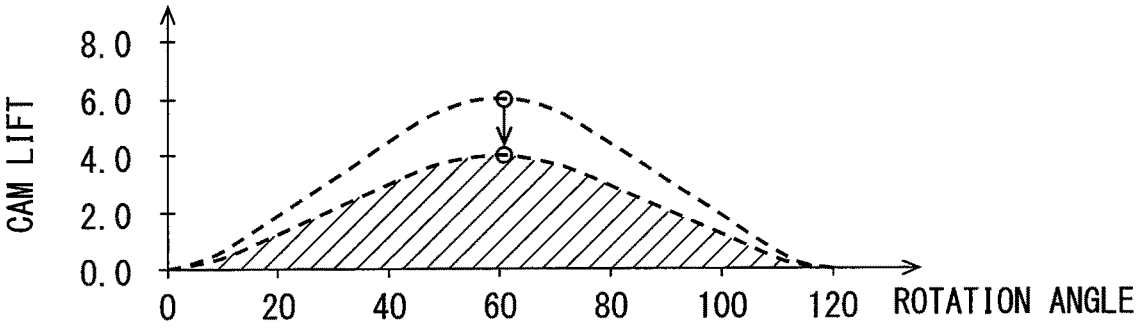
FIG. 7 shows changes in cam workload in accordance with changes in lift waveform.
Figure 8:
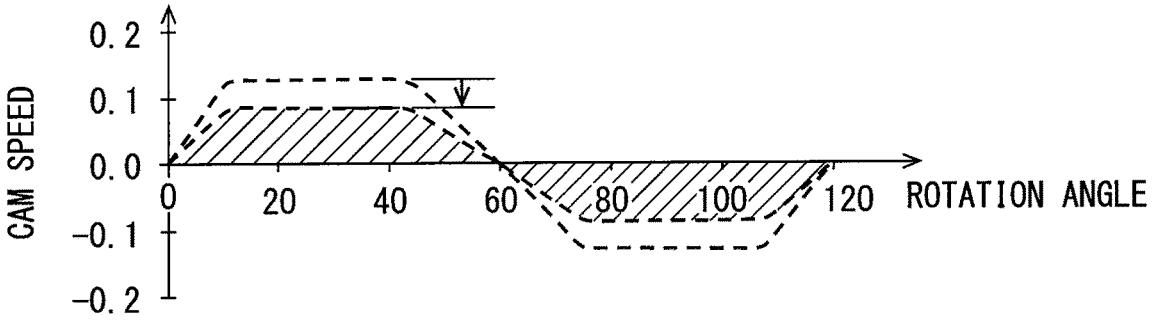
FIG. 8 shows changes in cam workload in accordance with changes in cam speed waveform

The cam workload is equivalent to the area under the lift waveform shown in FIG. 7 and the area under the cam speed waveform shown in FIG. 8. In other words, if maximum lift amount is reduced, the lift waveform peak value is reduced as shown by the arrow in FIG. 7, the cam speed waveform is reduced as shown by the arrow in FIG. 8, and so the cam workload is reduced as shown by the shaded areas. Accordingly, if the driving contact noise is reduced by simply reducing the maximum lift amount and the cam speed, the cam workload may become insufficient, and the discharge functionality of the fuel pump 1 may deteriorate.

Figure 6:
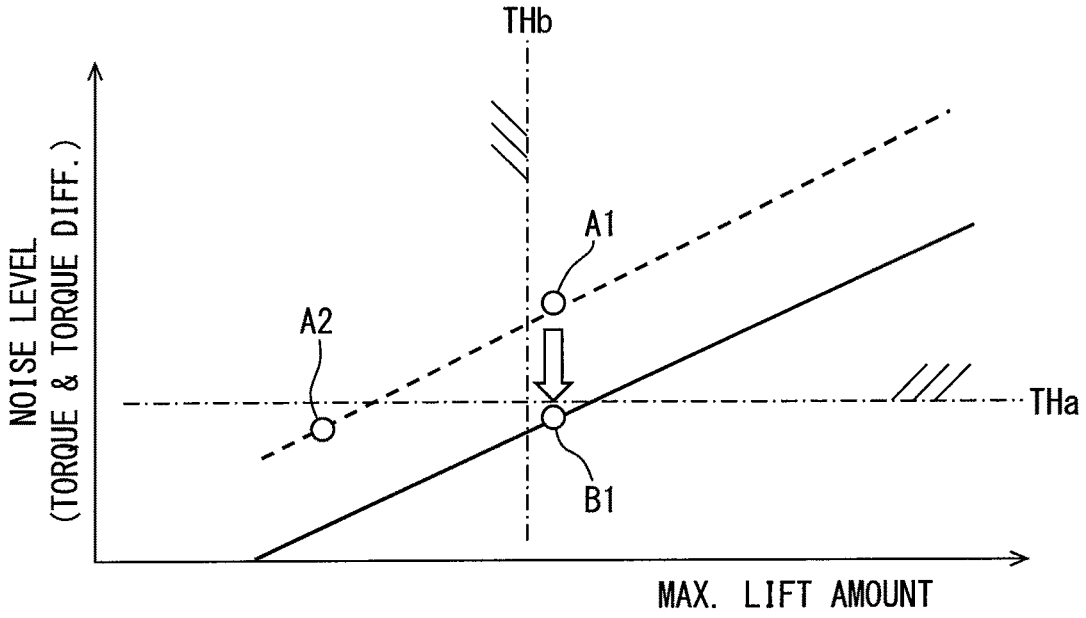
FIG. 6 shows a relationship between maximum lift amount and noise level.

In this regard, by using the cam 30 of the present embodiment which satisfies the previously mentioned conditions 1 to 7, a characteristic line as shown by the solid line of FIG. 6 may be achieved, and so the noise level may be reduced without reducing the maximum lift amount, as shown by the point B1. In other words, the maximum lift amount may be maintained at or above the target value THb, while the noise level may be reduced below the target value THa.

Next, the technical significant and operational effects of a cam profile which satisfies the above described conditions 1 to 7 will be explained.

According to condition 1, the peak arrival range Tacc is half or less of the compression range Tcomp. Accordingly, after the plunger 20 begins to lift up, the cam speed reaches the rising peak point P when or prior to half the compression range Tcomp has elapsed. Meanwhile, plunger load increases as the lift up amount increases and compression is performed. For this reason, due to condition 1, the cam speed may sufficiently increase early in compression period while plunger load is small. Accordingly, the peak value of collision load may be reduced without significantly decreasing the area under the lift waveform. In other words, driving contact noise may be reduced while maintaining cam workload.

Condition 2 requires that the cam speed, upon arriving at the rising peak point P, does not remain at the value at the rising peak point P, and immediately decreases. The technical significant of condition 2 is so that after the peak arrival range Tacc, cam workload may be maintained while quickly decreasing torque. Accordingly, driving contact noise may be reduced. Thus, if condition 2 is violated and the cam speed waveform is such that the rising peak point P is maintained for a relatively long period, this may adversely affect driving contact noise reduction. In view of the above, due to condition 2 which does not maintain the rising peak point P value, cam speed is quickly reduced after reaching the rising peak point P, and so driving contact noise may be further reduced.

Regarding the technical significant of condition 3, by reducing the number of times that cam speed rises, i.e., the number of times that cam acceleration increases, driving contact noise may be reduced. Accordingly, if condition 3 is violated such that the rising peak point P occurs a plurality of times, then cam speed also increases a plurality of times during one compression range Tcomp, and this may adversely affect driving contact noise reduction. In view of the above, due to condition 3 which requires that the rising peak point P only occurs once, the number of times that cam speed increase, i.e., the number of times that cam acceleration increases, may be set to a minimum number, and so driving contact noise may be further reduced.

Regarding the technical significant of condition 4, by reducing the peak range Tpeak, this means cam speed quickly rises to reach the rising peak point P, and then also quickly falls from the rising peak point P. Accordingly, as the peak range Tpeak decreases, the effect of condition 1, i.e., the cam speed reaching the rising peak point P quickly, is strongly exhibited. In addition, the effect of condition 2, i.e., cam speed quickly decreasing after reaching the rising peak point P, is also strongly exhibited. In view of the above, due to condition 4 which requires the peak range Tpeak to be one third or less of the compression range Tcomp, the peak range Tpeak is sufficiently reduced, the effects of condition 1 and condition 2 are strongly exhibited, and so driving contact noise may be further reduced.

Regarding the technical significance of condition 5, by reducing cam acceleration during the peak following waveform Wb, cam speed quickly decreases from the rising peak point P, i.e., the torque differential value may be reduced. In the peak following waveform Wb, the cam speed value is greater as compared to the compression end waveform Wa. Accordingly, driving contact noise may be greater during the peak following range Tb than during the compression end range Ta. Thus, by reducing cam acceleration in the peak following waveform Wb, it is possible to avoid excess driving contact noise during the peak following range Tb. In view of the above, due to condition 5 which requires that cam acceleration $\Delta V$ includes a portion which is equal to or below $-0.001$ mm/deg$^2$, and this portion exists within the peak following waveform Wb, it is possible to avoid excess driving contact noise during the peak following range Tb, and so driving contact noise may be further reduced.

Regarding the technical significance of condition 6, in the compression end waveform Wa, cam speed is a smaller value as compared to the peak following waveform Wb, and so there is less of a concern regarding driving contact noise during the compression end range Ta as compared to the peak following range Tb. Accordingly, by increasing cam speed in the compression end waveform, the area of the cam speed waveform may be increased without significantly increasing driving contact noise, and so cam workload may be sufficiently maintained. In view of the above, according to condition 6, which requires that for at least a portion of the compression end waveform Wa, the cam speed value is greater than a straight line L connecting the rising peak point P and the end point A of the compression range Tcomp, cam workload may be increased without significantly increasing driving contact noise. Further, in the present embodiment, condition 6A is also satisfied where the entirety of the compression end waveform Wa may be at a greater cam speed value than the straight line L. Accordingly, the effects of condition 6, which is that cam workload may be increased without significantly increasing driving contact noise, are more strongly exhibited.

Regarding the technical significant of condition 7, as the compression range Tcomp increases, the area under the cam speed waveform may be sufficiently maintained and the cam speed value at the rising peak point P may be reduced. Further, the reduction of cam speed from the rising peak point P may be made more gradual. In other words, both cam speed and cam acceleration may be reduced, and as a result, the peak value of collision load may be further reduced. In view of the above, due to the effects of condition 7, which requires that the compression range Tcomp be greater than the suction range Tsuc, cam workload may be maintained while reducing collision load by reducing cam speed and cam acceleration, and so driving contact noise may be further reduced.

Figure 9:
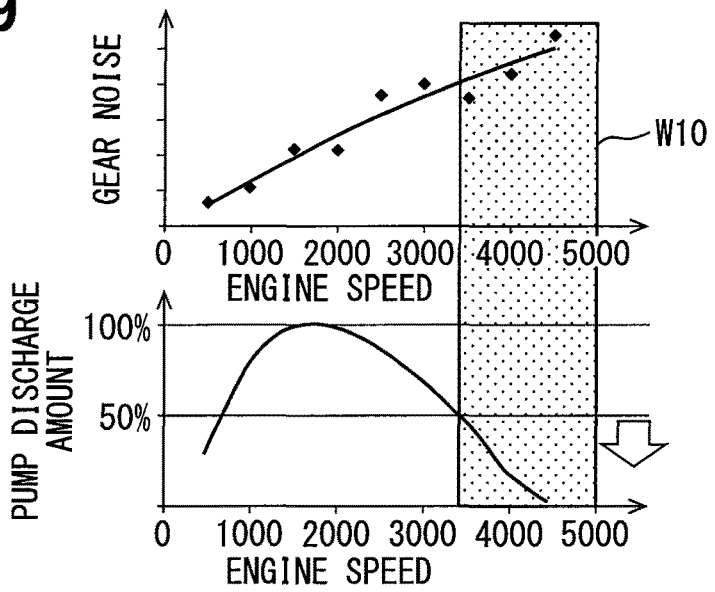
FIG. 9 shows a relationship between requested pump discharge amount, gear noise, and engine rotation speed.

Here, the bottom of FIG. 9 shows a relationship between a pump discharge amount required of the fuel pump 1 used in a typical internal combustion engine and an engine rotation speed representing the rotation speed of the output shaft of the internal combustion engine. The vertical axis represents the maximum discharge amount of the fuel pump 1 at 100%, and half of the maximum discharge amount at 50%. As illustrated, in the low speed region of the engine rotation speed, the requested pump discharge amount increases as the rotation speed increases. Conversely, in the high speed region, the requested pump discharge amount decreases as the rotation speed increases. In other words, the requested discharge amount does not simply increase as rotation speed increases, but rather has a peak discharge amount value at a particular rotation speed.

Further, since the power source of the fuel pump 1 is the output of the internal combustion engine, as the engine rotation speed increases, the rotation speed of the cam 30 also increases. For this reason, as shown in the top of FIG. 9, noise from the gears and teeth increase as engine rotation speed increases, regardless of whether the engine rotation speed is in the high speed region or not. Accordingly, in the high speed regions where gear noise significantly increases (e.g., region W10), it is more desirable to reduce gear noise as compared to the low speed regions.

Further, when considering both the top and bottom of the FIG. 9, it is understood that in the region W10 of the high speed region where it is desirable to prioritize reducing gear noise, the pump discharge amount is lower than 100%. Accordingly, in the region W10 of the engine rotation speed where pump discharge amount is low, it could be said that gear noise reduction is of a higher priority as compared to when the pump discharge amount is near 100%.

In addition, as mentioned previously, by controlling the closing timing of the regulator valve 60, the compression start timing of the plunger 20, i.e., the pump discharge amount, may be controlled. Accordingly, a low pump discharge amount also means that the actual compression start timing of the compression range Tcomp is slower (later).

Figure 10:
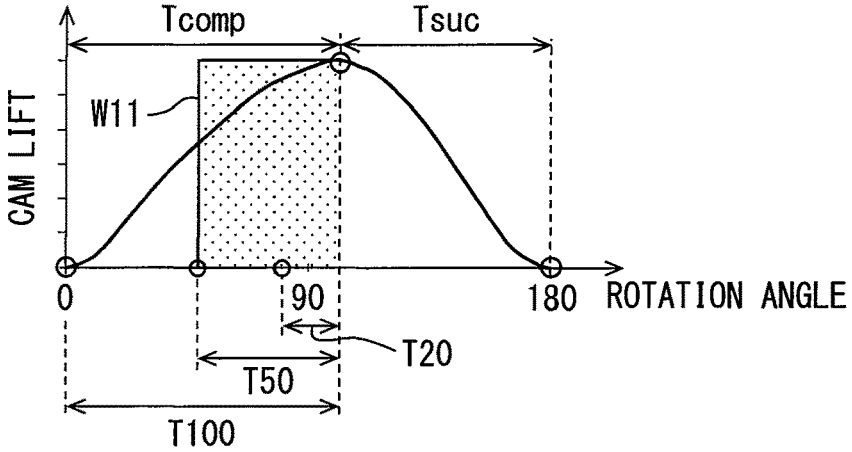
FIG. 10 shows a relationship between actual pressure range and cam lift waveform.
Figure 11:
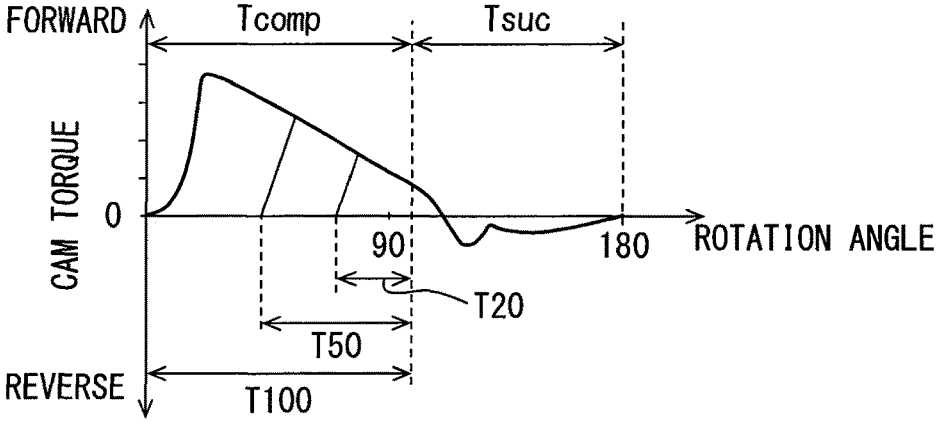
FIG. 11 shows a relationship between actual pressure range and cam lift waveform.

Specifically, as shown in FIG. 10, when the pump discharge amount is at 100%, the regulator valve 60 closes at the same time as when the cam 30 begins lifting up to begin compression, and the compression range Tcomp coincides with an actual compression range T100. In other words, as shown in FIG. 11, cam torque begins rising at the same as when lift up begins. Conversely, when the pump discharge amount is at 50%, the regulator valve 60 closes after the cam 30 has rotated by a particular rotation angle from when lift up started, and then compression begins. For this reason, an actual compression range T50 is shorter than the compression range Tcomp. Further, the compression start timing is later than the lift up start timing (see FIG. 10). In other words, cam torque begins rising after lift up begins (see FIG. 11). Further, when the pump discharge amount is 20%, an actual compression range T20 is even shorter, and the compression start timing is even later.

Accordingly, FIGS. 9 to 11 show that in the high speed region of the engine rotation speed, there is a higher priority in reducing gear noise as compared to the low speed regions. Further, in this high speed region, the required pump discharge amount is not maximum (and may be, for example, 50% or less), and in this case, cam torque begins rising later. Accordingly, in the cam speed waveform W shown in FIG. 4, there are more cases where cam torque does not begin increasing during the early periods of the compression range Tcomp. Accordingly, during the early period of the compression range Tcomp, even if cam speed and cam acceleration are high, there are fewer opportunities for driving contact to increase. Conversely, as the rotation angle approaches the end point of the compression range Tcomp, there is a higher probability of driving contact noise increasing as cam speed and cam acceleration increase.

Further, with a cam profile that satisfies condition 1 mentioned previously, since cam speed quickly increases in the early period of the compression range Tcomp, cam speed and cam acceleration are high during this early period. However, even if cam speed and cam acceleration are high during this early period, there are fewer cases of driving contact noise increasing, and so there is little concern of the first condition increasing driving contact noise. Conversely, according to condition 1, during the period after the early period, when there is a concern regarding driving contact noise, cam speed is lowered for a longer period after the initial period, and so driving contact noise may be effectively reduced.

In other words, the technical idea of condition 1 is to quickly increase cam speed during the early period where driving contact noise is of little concern, and gradually decrease cam speed in the later periods when there is a greater concern regarding driving contact noise. As a result, cam workload may be maintained while reducing noise.

Second Embodiment

Figure 12:
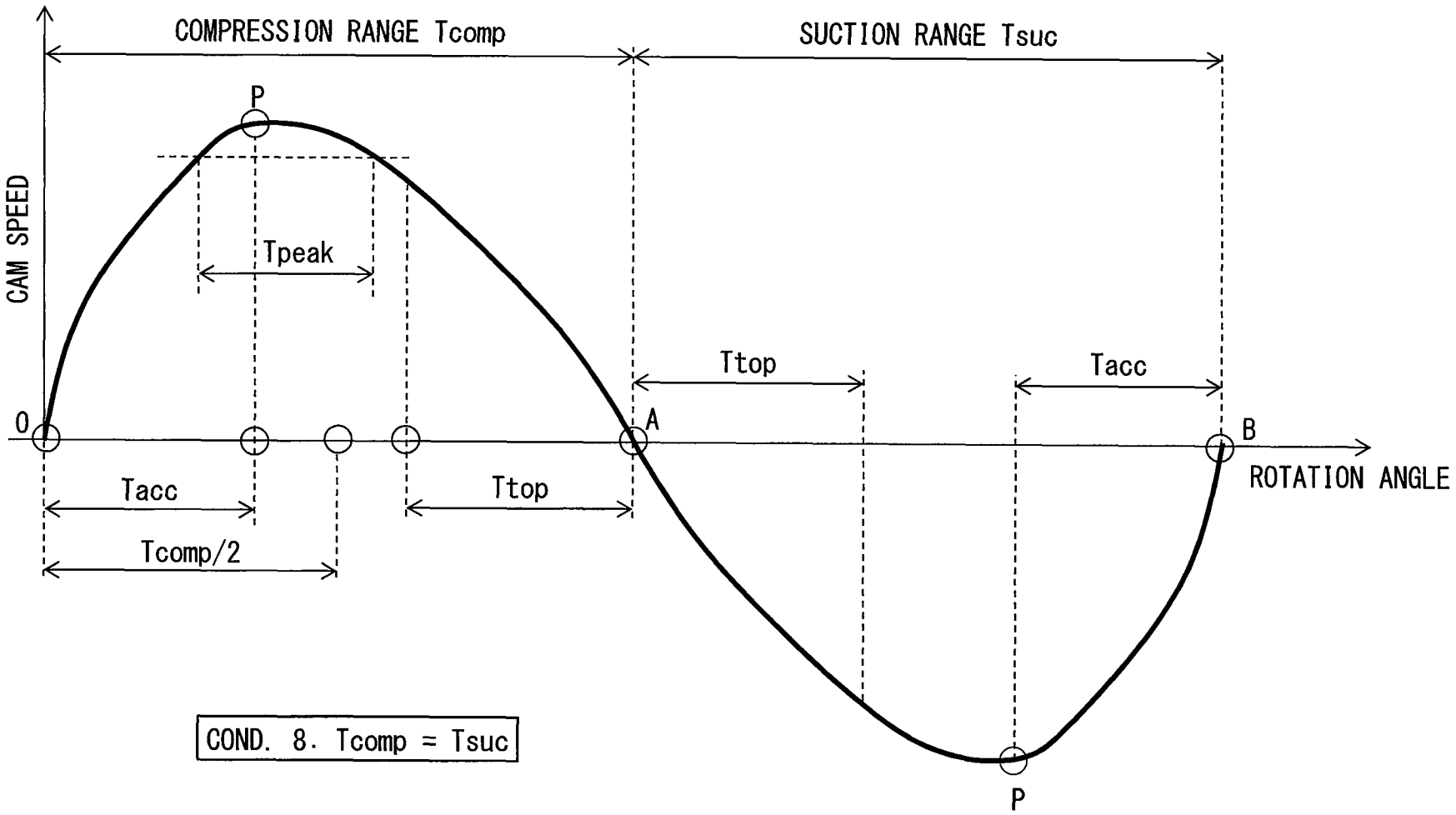
FIG. 12 shows a cam speed waveform.

Accordingly to the first embodiment described above, as shown in FIG. 4, the cam profile is configured such that the compression range Tcomp is greater than the suction range Tsuc so as to satisfy condition 7. However, in the present embodiment as shown in FIG. 12, instead of condition 7 mentioned above, the cam profile is configured such that a condition 8 is satisfied where the compression range Tcomp is the same size as the suction range Tsuc. Further, conditions 1 to 6 in the present embodiment are satisfied in the same manner as the first embodiment above.

Further according to the present embodiment, the cam profile is configured such that the cam speed waveform W obtained when the cam 30 is rotating forward is the same as the cam speed waveform W when the cam 30 is rotating in reverse (condition 9). Specifically, as shown in FIG. 12, Tcomp is equal to Tsuc. Further, the waveform in the compression range Tcomp and the waveform in the suction range Tsuc are point symmetric with each other about the point A.

In view of the above, according to the present embodiment, at least the same effects of conditions 1 to 6 are exhibited as the first embodiment above. Further according to the present embodiment, conditions 8 and 9 are satisfied, and so the same cam speed waveform W may be obtained regardless of which direction the cam 30 is mounted to the rotation shaft 40. Accordingly, the manufacturability of mounting the cam 30 on the rotation shaft 40 may be improved.

First Modified Embodiment

Figure 13:
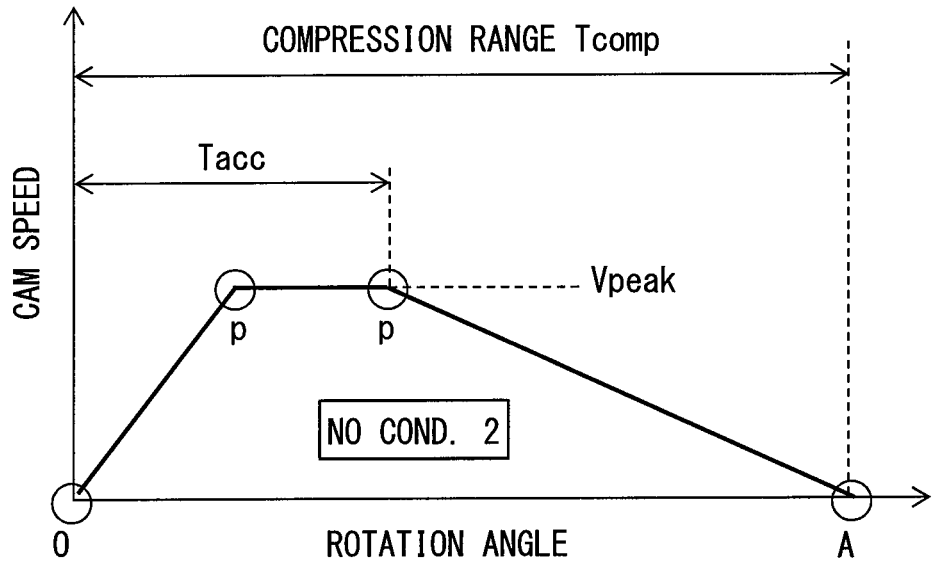
FIG. 13 shows a cam speed waveform.

In the present modified embodiment, condition 2, which requires that the cam speed, upon arriving at the rising peak point P, does not remain at the value at the rising peak point P, and immediately decrease, is not satisfied. Instead, as shown in FIG. 13, a peak speed Vpeak at the rising peak point P is maintained for a particular angle range. In this case, the peak arrival range Tacc is the maximum range between the start of the compression range Tcomp and the range in which the rotation speed is maintained. In other words the peak arrival range Tacc is defined as a range until the most retarded angle of the rising peak point P. Further, in the present modified embodiment, the remaining conditions 1 and 3 to 7 are satisfied similar to the first embodiment above. Accordingly, in the present modified embodiment, the effects of conditions 1 and 3 to 7 may be exhibited in a similar manner as the first embodiment above.

Second Modified Embodiment

Figure 14:
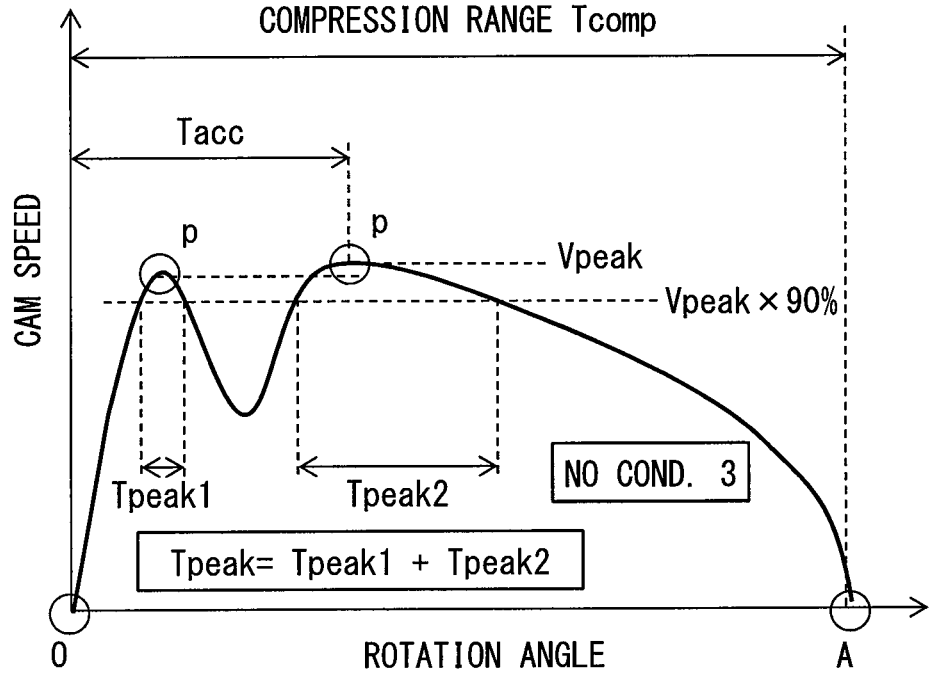
FIG. 14 shows a cam speed waveform.

In the present modified embodiment, condition 3, which requires that the rising peak point P occurs once during the compression range Tcomp, is not satisfied. Instead, as shown in FIG. 14, the rising peak point P occurs a plurality of times (specifically, twice). In this case, the peak arrival range Tacc is defined as a range from the start of the compression range Tcomp until the rising peak point P of the highest rotation angle. Further, according to the present modified embodiment, there are a plurality of places (specifically, two places) at or over 90% of the peak speed Vpeak, and so the size of this peak range Tpeak is defined as the sum of each peak ranges Tpeak1, Tpeak2.

Further, in the present modified embodiment, the remaining conditions 1, 2, and 4 to 7 are satisfied similar to the first embodiment above. Accordingly, in the present modified embodiment, the effects of conditions 1, 2, and 4 to 7 may be exhibited in a similar manner as the first embodiment above.

Third Modified Embodiment

Figure 15:
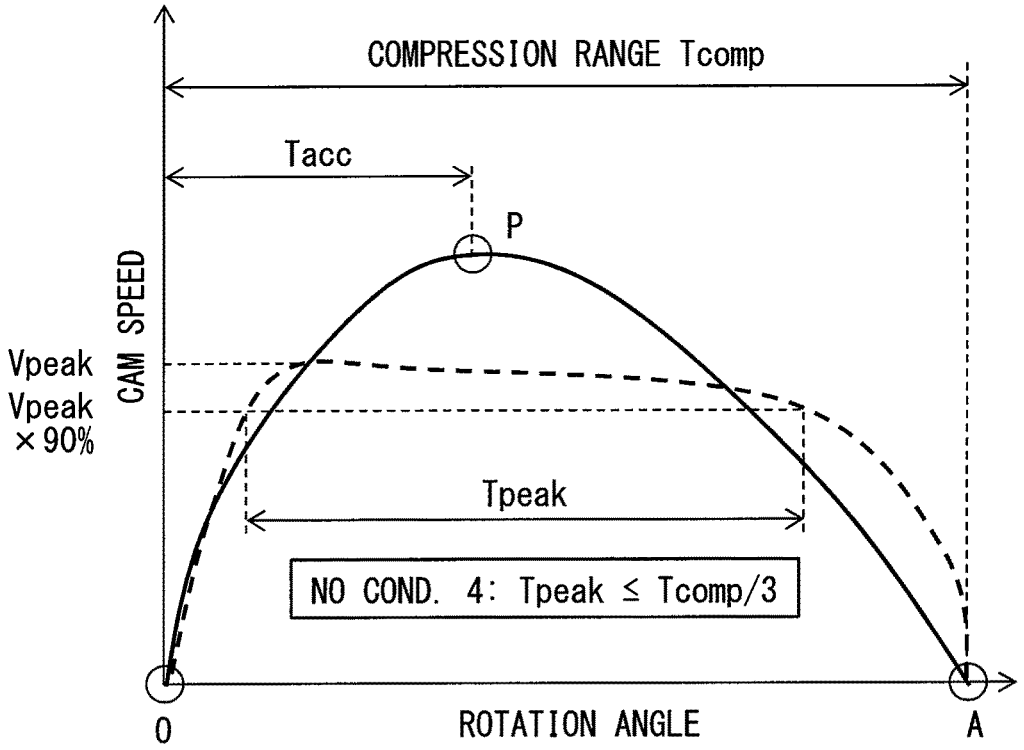
FIG. 15 shows a cam speed waveform.

In the present modified embodiment, condition 4, which requires that the peak range Tpeak is one third or less of the compression range Tcomp, is not satisfied. Instead, as shown by the dashed line in FIG. 15, the peak range Tpeak is equal to or greater than one third of the compression range Tcomp. The solid line in FIG. 15 shows the cam speed waveform of the first embodiment where, since condition 4 is satisfied, the waveform has about a triangular shape in the compression range Tcomp. Conversely, in the present modified embodiment shown by the dashed line, since condition 4 is not satisfied, the waveform has a shape closer to a trapezoid.

Further, in the present modified embodiment, the remaining conditions 1 to 3 and 5 to 7 are satisfied similar to the first embodiment above. Accordingly, in the present modified embodiment, the effects of conditions 1 to 3 and 5 to 7 may be exhibited in a similar manner as the first embodiment above.

Fourth Modified Embodiment

Figure 16:
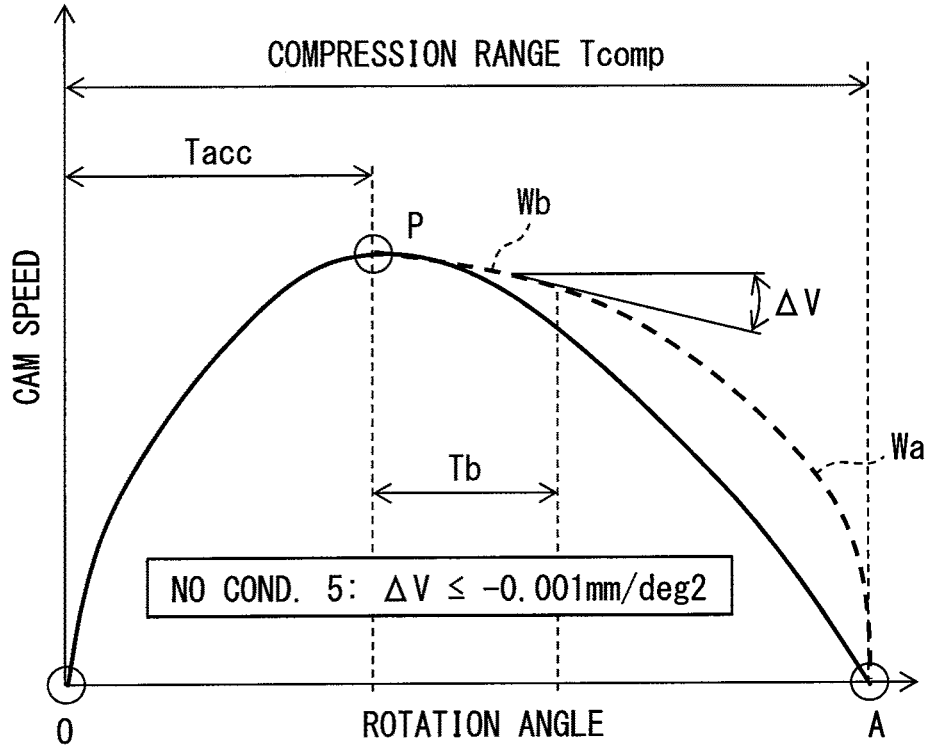
FIG. 16 shows a cam speed waveform.

In the present modified embodiment, condition 5, which requires that the cam acceleration $\Delta V$ includes a portion which is equal to or below $-0.001$ mm/deg$^2$, and this portion exists within the peak following waveform Wb, is not satisfied. Instead, as shown by the dashed line in FIG. 16, the cam acceleration $\Delta V$ is greater than $-0.001$ mm/deg$^2$ in all sections of the peak following waveform Wb. In other words, in the peak following waveform Wb, the cam speed waveform is such that cam speed gradually decreases and, to compensate for that, cam speed rapidly decreases during the compression end waveform Wa.

Further, in the present modified embodiment, the remaining conditions 1 to 4 and 6 to 7 are satisfied similar to the first embodiment above. Accordingly, in the present modified embodiment, the effects of conditions 1 to 4 and 6 to 7 may be exhibited in a similar manner as the first embodiment above.

Fifth Modified Embodiment

Figure 17:
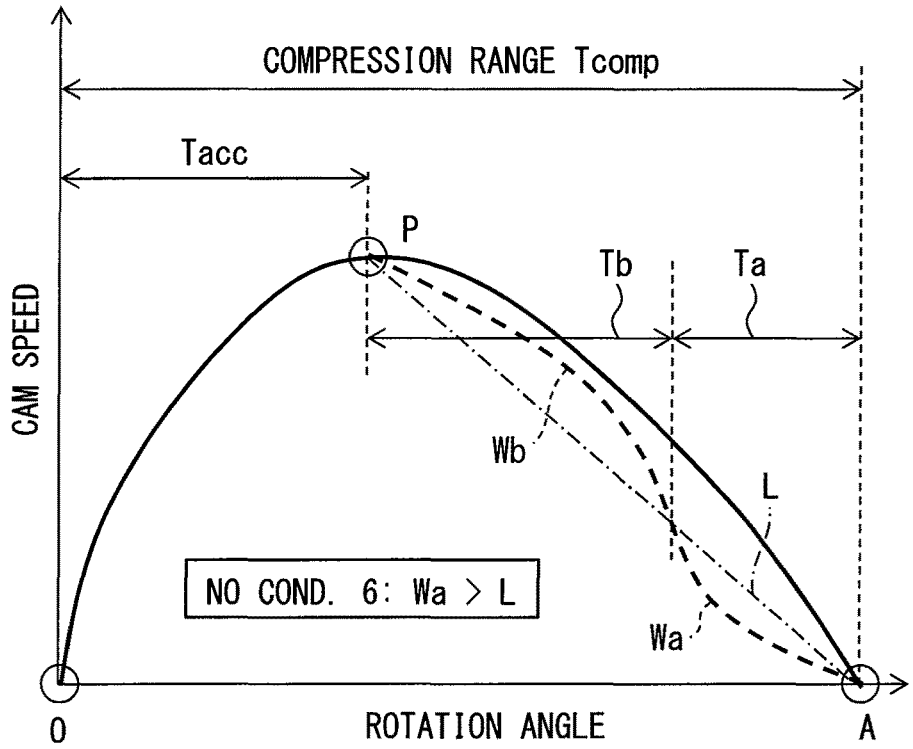
FIG. 17 shows a cam speed waveform.

In the present modified embodiment, condition 6, which requires that for at least a portion of the compression end waveform Wa, the cam speed value is greater than a straight line L connecting the rising peak point P and the end point A of the compression range Tcomp, is not satisfied. Instead, as shown by the dashed line in FIG. 17, cam speed is lower than the straight line L in all portions of the compression end waveform Wa.

Further, in the present modified embodiment, the remaining conditions 1 to 5 and 7 are satisfied similar to the first embodiment above. Accordingly, in the present modified embodiment, the effects of conditions 1 to 5 and 7 may be exhibited in a similar manner as the first embodiment above.

Sixth Modified Embodiment

Figure 18:
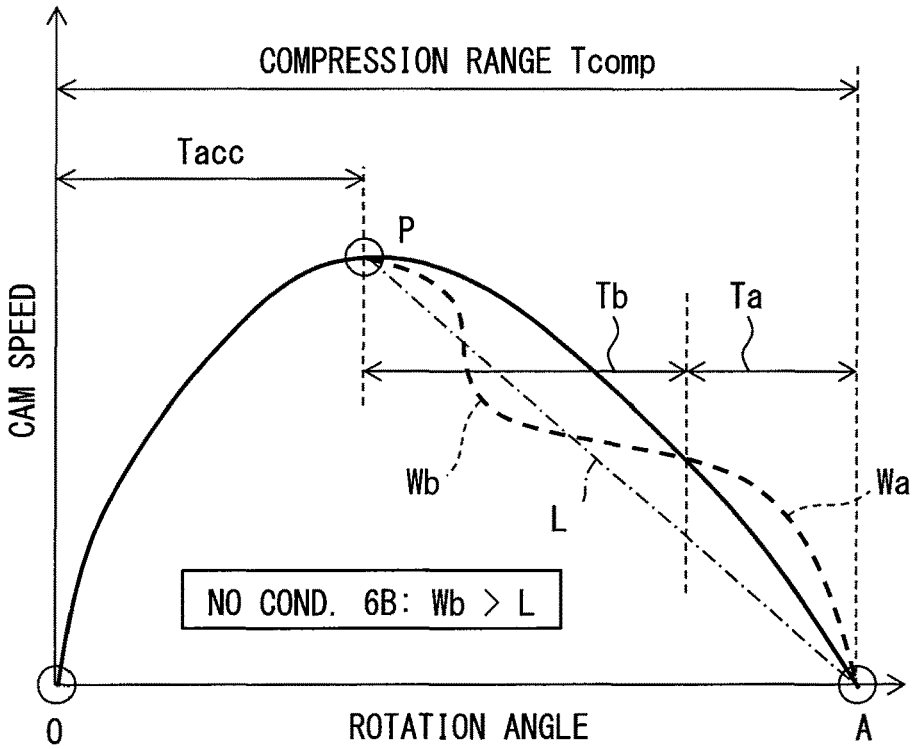
FIG. 18 shows a cam speed waveform.

In the present modified embodiment, condition 6B, which requires that the entirety of the compression end range Ta and the peak following range Tb to be at a greater cam speed value than the straight line L, is not satisfied. Instead, as shown by the dashed line in FIG. 18, cam speed is lower than the straight line L during a portion of the peak following range Tb or a portion of the compression end range Ta.

Further, in the present modified embodiment, the remaining conditions 1 to 7 are satisfied similar to the first embodiment above. Accordingly, in the present modified embodiment, the effects of conditions 1 to 7 may be exhibited in a similar manner as the first embodiment above.

Other Embodiments

Above, a plurality of embodiments of the present disclosure are described, but these embodiments are not intended to be limiting, and a variety of embodiments and combinations which do not depart from the gist of the present disclosure are contemplated. Further, the embodiments are not limited to combinations which are explicitly described, but rather, at long as no problems occur, the embodiments may be combined with each other in manners which are not explicitly described.

In the embodiment shown in FIG. 1, the cam 30 has a shape with two peaks, and so during one rotation of the cam 30, the plunger 20 reciprocates twice. Accordingly, in the lift waveform and the cam speed waveform, one period of the rotation angle, which is the sum of the compression range Tcomp and the suction range Tsuc, is 180 degrees. However, a cam 30 having a shape with three peaks may be used so that one period of rotation angle is 120 degrees. Further, cams with four or more peaks may be used as appropriate.

In the embodiment shown in FIG. 1, the power source of the cam 30 is the internal combustion engine. However, an electric motor may be used as the power source of the cam 30 instead.

In the first embodiment described above, the cam profile is configured such that all conditions 1 to 7 are satisfied. However, as long as condition 1 is satisfied, conditions 2 to 7 may be not satisfied.

The invention claimed is:

1. A fuel pump configured to compress and discharge fuel, comprising:

a cylinder configured to form a compression chamber which pressurizes a fuel;

a plunger configured to compress the fuel in the compression chamber;

a cam configured to push the plunger in a direction of compressing the fuel; and a driven gear configured to engage a driving gear to rotate, the driven gear transmitting a rotational driving force of the driving gear to the cam to rotate the cam, wherein the cam pushes the plunger by a lift amount, a cam speed includes a value obtained by differentiating the lift amount by a rotation angle of the cam, a compression range includes an angle range of the rotation angle during which the plunger is pushed in the direction of compressing the fuel, a suction range includes an angle range of the rotation angle during which the plunger is pushed in a direction of sucking in the fuel, a peak arrival range includes an angle range from a start of the compression range until a most retarded position of a peak of the cam speed, a profile of the cam is configured such that the peak arrival range is less than 40% of the compression range, and such that the compression range is greater than the suction range, a cam speed waveform includes a waveform representing changes in the cam speed with respect to changes in the rotation angle, a compression end waveform includes a partial angle range of the cam speed waveform, starting from a rotation angle retarded from the peak by a particular angle and until the compression range ends, and the profile of the cam is configured such that for an entire angle range of the cam speed waveform from the peak until the end point of the compression range, the cam speed is greater than a straight line that connects a point at the peak with the end point of the compression range.

2. The fuel pump of claim 1, wherein the profile of the cam is configured such that the cam speed decreases upon reaching the peak without being maintained at a value of the peak.

3. The fuel pump of claim 1, wherein the profile of the cam is configured such that the peak occurs once during the compression range.

4. The fuel pump of claim 1, wherein a peak speed includes the cam speed at the peak, a peak range includes a range of the compression range during which the cam speed is equal to or above 90% of the peak speed, and the profile of the cam is configured such that the peak range is one third or less of the compression range.

5. The fuel pump of claim 1, wherein a peak following waveform includes a partial angle range of the cam speed waveform, from the peak until a rotation angle retarded from the peak by a particular angle, cam acceleration includes a value obtained by differentiating the cam speed by the rotation angle, and the profile of the cam is configured such that the cam acceleration includes a portion which is equal to or below $-0.001$ mm/deg$^2$, and the portion exists within the peak following waveform.

6. The fuel pump of claim 1, wherein the profile of the cam is configured such that the peak arrival range is ⅓ or less of the compression range.

7. A fuel pump configured to compress and discharge fuel, comprising:

a cylinder configured to form a compression chamber which pressurizes a fuel;

a plunger configured to compress the fuel in the compression chamber;

a cam configured to push the plunger in a direction of compressing the fuel; and a driven gear configured to engage a driving gear to rotate, the driven gear transmitting a rotational driving force of the driving gear to the cam to rotate the cam, wherein the cam pushes the plunger by a lift amount, a cam speed includes a value obtained by differentiating the lift amount by a rotation angle of the cam, a compression range includes an angle range of the rotation angle during which the plunger is pushed in the direction of compressing the fuel, a suction range includes an angle range of the rotation angle during which the plunger is pushed in a direction of sucking in the fuel, a peak arrival range includes an angle range from a start of the compression range until a most retarded position of a peak of the cam speed, a profile of the cam is configured such that the peak arrival range is half or less of the compression range, and such that the compression range is greater than the suction range, a cam speed waveform includes a waveform representing changes in the cam speed with respect to changes in the rotation angle, a compression end waveform includes a partial angle range of the cam speed waveform, starting from a rotation angle retarded from the peak by a particular angle and until the compression range ends at an end point of the compression range, and the profile of the cam is configured such that for an entire angle range of the cam speed waveform from the peak until the end point of the compression range, the cam speed is greater than a straight line that connects a point at the peak with the end point of the compression range.

* * * * *